United States Patent [19]

Coffman

[11] Patent Number: 5,036,602

[45] Date of Patent: Aug. 6, 1991

[54] HEAT RECIRCULATING DRYER

[75] Inventor: Randall R. Coffman, Palatine, Ill.

[73] Assignee: Norman Dryer Division of G. A. Braun, Inc., Syracuse, N.Y.

[21] Appl. No.: 484,404

[22] Filed: Feb. 26, 1990

[51] Int. Cl.[5] ..... F26B 11/04

[52] U.S. Cl. ..... 34/133; 432/105

[58] Field of Search ..... 34/133, 86, 136, 137, 34/132; 432/105, 107

[56] References Cited

U.S. PATENT DOCUMENTS 3,969,070 7/1976 Thompson ..... 34/133

4,665,628 5/1987 Clawson ..... 34/133

*Primary Examiner*—Henry A. Bennet

*Attorney, Agent, or Firm*—Lee, Mann, Smith, McWilliams & Sweeney

[57] ABSTRACT

A dryer for extracting moisture from goods and recirculating at least a portion of the air withdrawn from a tumbler cylinder located within the dryer. The dryer includes an air distribution system for supplying heated air to the tumbler cylinder, withdrawing air from the cylinder, and recirculating at least a portion of the air withdrawn from the cylinder. The air distribution system includes a burner tube and a heating passageway disposed about a portion of the burner tube, the passageway being connected for directing recirculated air about the burner tube to heat the recirculated air. The air circulating system also includes an air flow tube concentric with a portion of the burner tube for directing ambient air about the burner tube for cooling the burner tube.

10 Claims, 3 Drawing Sheets

10
24
4
EXHAUST
20
46
42
38
4
48
26
62
62
66
36
36
30
36
32
14
18
66
18
16
14
12
20
22

HEAT RECIRCULATING DRYER

BACKGROUND OF THE INVENTION

This invention relates to dryers for extracting moisture from wet goods, and in particular to a heat recirculating dryer having improved efficiency and recirculating capabilities.

Dryers of the nature of the present invention are typically utilized in commercial laundering facilities where large quantities of wet linens are dried in batches of up to several hundred pounds. Wet linens are delivered to the dryer in large "cakes" such as those illustrated in U.S. Pat. No. 4,509,275, the disclosure of which is incorporated herein by reference.

A typical commercial dryer includes a tumbler cylinder mounted for rotation about a horizontal axis and which has an open side through which cakes of linens are inserted and the dried goods are removed. The cylinder is housed within a shell and is rotated about the horizontal axis. The shell is pivoted at either its bottom or its top (as illustrated in referenced U.S. Pat. No. 4,509,275), so that the shell can be tipped to permit dry linens to be removed therefrom.

As energy costs have escalated, it has become particularly important that the efficiency of the dryer be as high as possible. Thus, dryers have begun incorporating recirculating systems so that a portion of the air withdrawn from the tumbler cylinder is recirculated back to the dryer so that the eventually-exhausted air is as close as possible to the dew point, thus utilizing to the extent possible the moisture trapping capability of the air introduced into the tumbler cylinder for drying of the goods therewithin. The means of recirculation of such prior dryers has typically been a damper located in the exhaust duct to cause a portion of the air to be recirculated directly back into the tumbler cylinder. By judicious adjustment of the damper, greater or smaller portions of the recirculated air can be reintroduced into the tumbler cylinder.

SUMMARY OF THE INVENTION

The dryer of the invention is of the type for extracting moisture from wet goods, and includes a tumbler cylinder housed within a shell. It also includes an air distribution means for supplying heated air to the tumbler cylinder for drying goods therein, withdrawing air from the cylinder, and recirculating at least a portion of the air withdrawn from the cylinder. In accordance with the invention, the air distribution means includes a burner chamber within a burner tube for providing heated air. Heating passageway means is disposed about at least a portion of the burner tube, the heating passageway means being connected for directing recirculated air about the burner tube to cause the burner tube to heat the recirculated air. An air flow tube surrounds at least a portion of the burner tube at the inlet end of the burner tube and is located for directing ambient air about the burner tube. A source of ambient air is also provided.

In accordance with the preferred form of the invention, the burner tube is cylindrical, and the heating passageway means comprises a duct. The duct extends about at least half of the circumference of the burner tube for part of the length thereof. The air flow tube is concentric with the burner tube, and is formed so that the direction of air flow between the air flow tube and the burner tube is opposite to the direction of air flow within the burner tube.

The air distribution means includes a recirculation duct extending from a location proximate the tumbler cylinder to the heating passageway duct, and includes separate means for exhausting some or all of the recirculated air before the air enters the heating passageway duct. That separate means comprises an adjustable damper located in the recirculation duct, and an exhaust duct associated with the damper to exhaust air channeled to the exhaust duct by the damper.

The shell of the dryer is pivotable to expel the contents thereof, and the recirculation duct includes a first part pivotable with the shell and a fixed second part. The parts meet at a joint which comprises a flanged collar on each of the parts, the collars abutting one another. Each collar preferably includes an oppositely curved periphery to prevent interference between the collars when the shell is pivoted.

BRIEF DESCRIPTION OF THE DRAWINGS

The invention is described in greater detail in the following description of an example embodying the best mode of the invention, taken in conjunction with the drawing figures, in which.

DESCRIPTION OF AN EXAMPLE EMBODYING THE BEST MODE OF THE INVENTION

Figure 1:
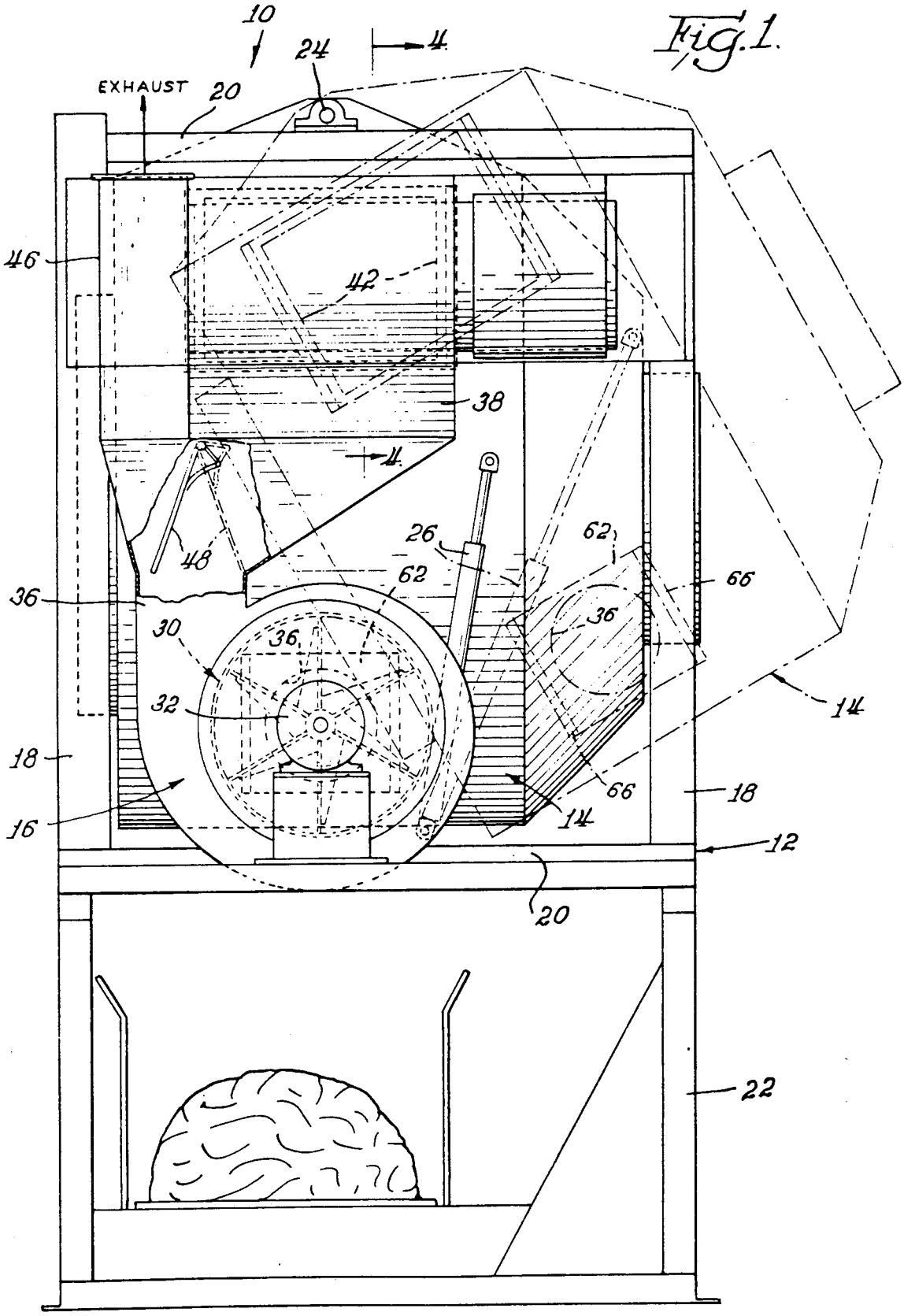
FIG. 1 is a side elevational view of a dryer according to the invention with the pivotable tumbler shell shown in phantom when pivoted, and also including a portion broken away to show a deflecting damper for recirculating and exhaust purposes.

A dryer according to the invention is shown generally at 10 in the drawing figures. Primary components of the dryer 10 are an external support or frame 12, a pivotable tumbler shell 14, and an air distribution system 16.

The frame 12 comprises a box-like framework composed of a series of vertical posts 18 interconnected by a series of horizontal cross members 20 at the top and bottom of the frame 12. The entire frame 12 sits upon a base 22 also composed of a series of vertical and horizontal framework members. The frame 12 and base 22 may be essentially the same as those of referenced U.S. Pat. No. 4,509,275.

The tumbler shell 14 is mounted in the frame 12 by means of a pivot 24, and is pivoted by means of a pair of hydraulic cylinders 26 secured between the frame 12 and the shell 14. Extension of the rams of the cylinders 26 pivots the shell about the pivot 24, as shown in phantom in FIG. 1. The cylinders 26 and their means of attachment and operation are conventional.

A tumbler cylinder 28 is housed within the shell 14. For the ease of explanation, the cylinder 28 has been omitted from FIG. 1, and the details of suspension of the cylinder 28 within the shell 14 have also not been illustrated. Both the cylinder 28 and the shell 14 may be conventional, and preferably are as described in referenced U.S. Pat. No. 4,509,275.

Figure 2:
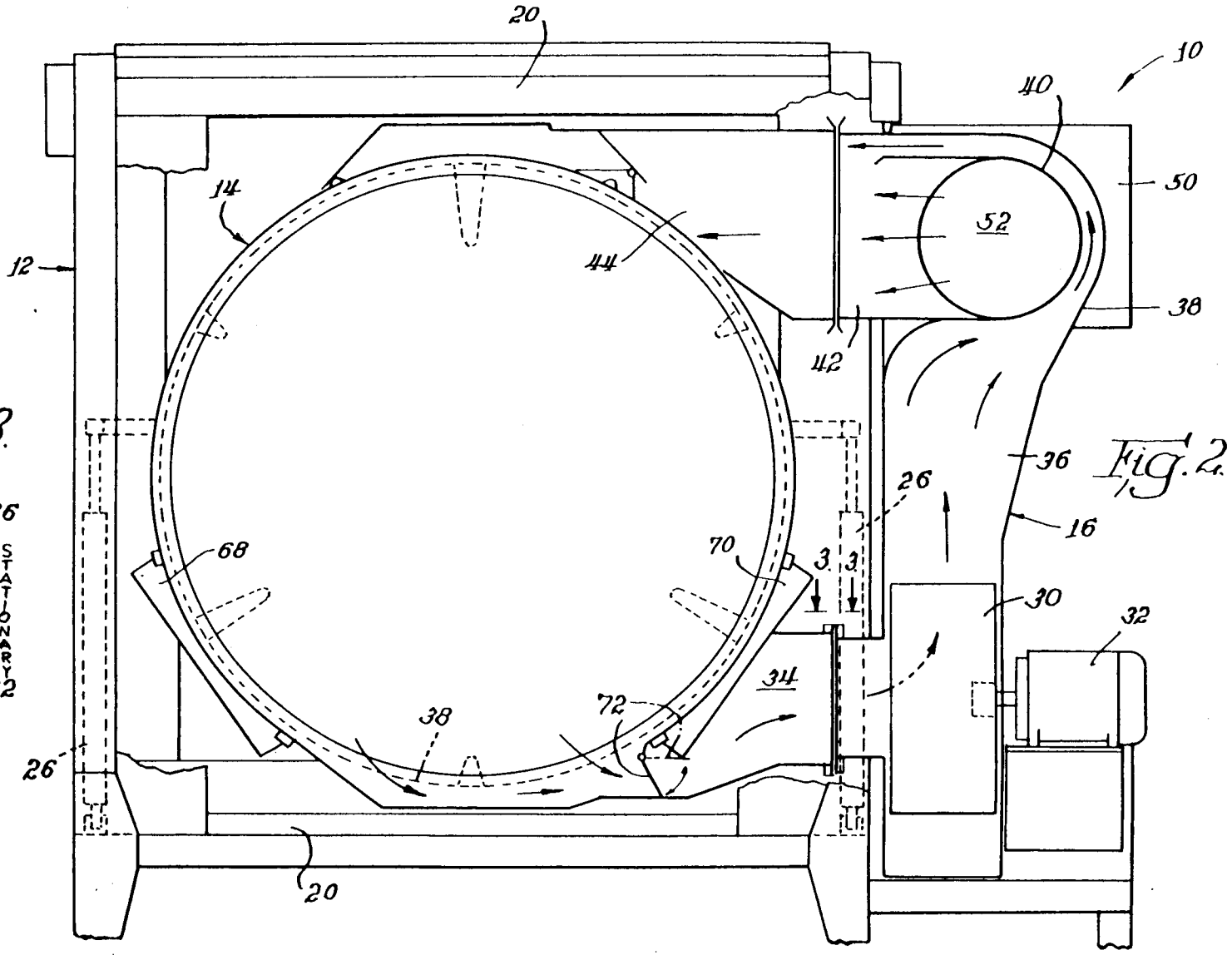
FIG. 2 is a front elevational view of the dryer according to the invention, with bottom framework portions and associated elements omitted for the purposes of clarity.

The air distribution system 16 includes a blower 30 which is rotated by an external motor 32 mounted on the frame 12. As shown by the directional arrows in FIG. 2, the blower 30 extracts air from the bottom of the tumbler cylinder 28, eventually returning all or a portion thereof to the top of the tumbler cylinder 28, as will be explained in a moment.

The air distribution system 16 includes a series of ducts. A first duct 34 leads from the base of the tumbler cylinder 28. The duct 34 joins a second duct 36 in which the blower 30 is located, and which rises to a duct 38 which extends about a portion of a burner tube 40 and expels into a duct 42. The duct 42 in turn is connected to a duct 44 leading to the top of the tumbler cylinder 28. As shown in FIG. 1, an exhaust duct 46 extends from the duct 36, and a damper 48 is mounted in the duct 36 to control air flow to the exhaust duct 46 and to the recirculating duct 38. In the position illustrated in FIG. 1, the damper 48 is permitting a minimum amount of exhaust out the exhaust duct 46, while recirculating a maximum amount of air into the duct 38. In the position shown in phantom in FIG. 1, however, the damper 48 prevents any air flow to the duct 38, thus exhausting all air through the exhaust duct 46.

The burner tube 40 is mounted within a housing 50. The burner tube 40 includes a burner chamber 52 within which a burner would be mounted. The burner is not illustrated for the purposes of simplicity, and may be conventional. The burner tube 40 exhausts to the duct 42, where heated air therefrom is joined with recirculated air from the duct 38.

Figure 4:
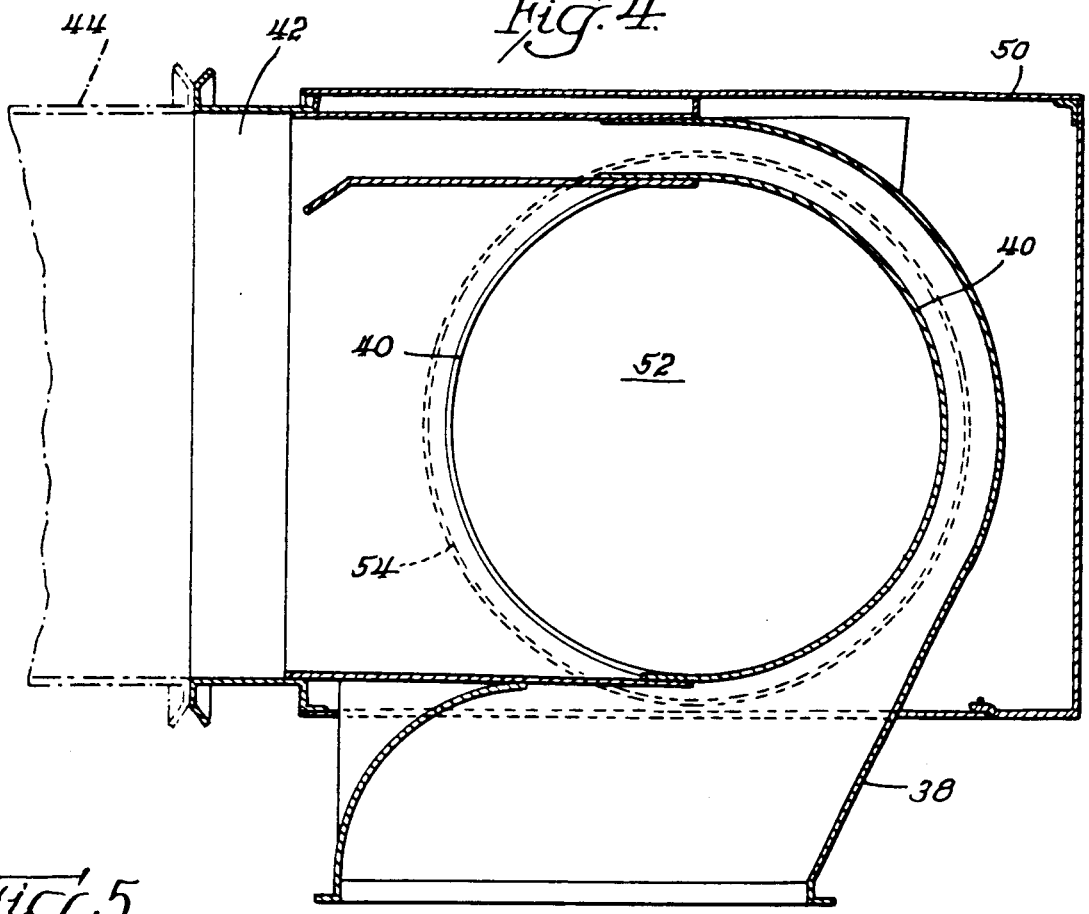
FIG. 4 is an enlarged cross-sectional view taken along lines 4—4 of FIG. 1, at the outlet end of the burner tube.
Figure 5:
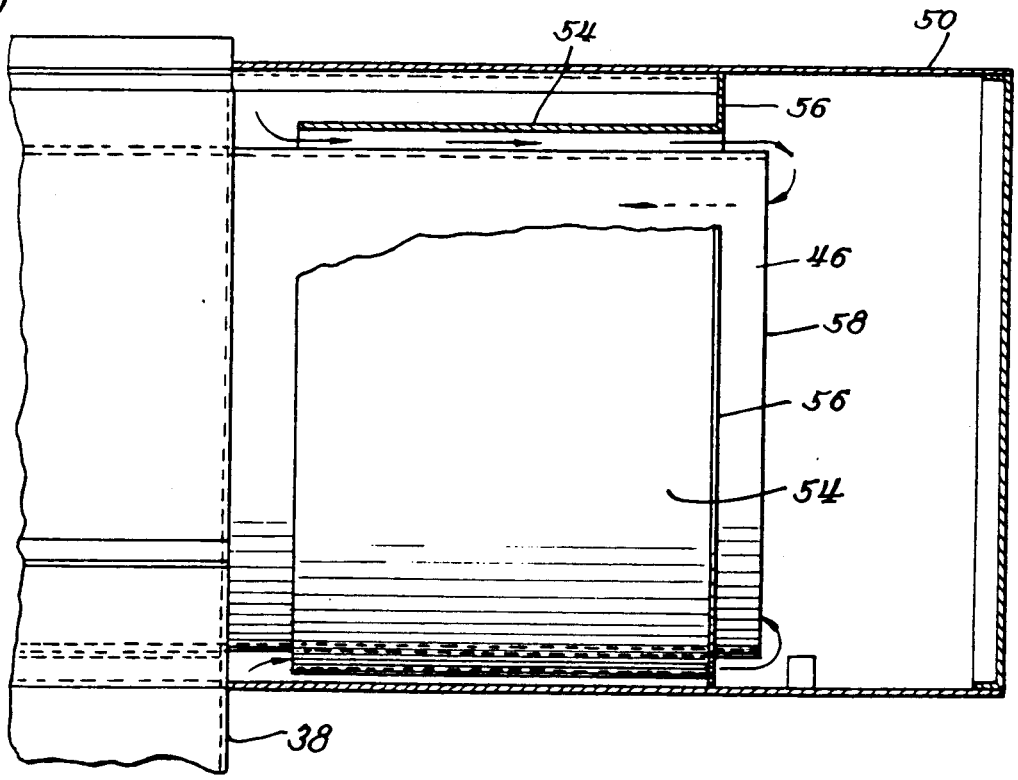
FIG. 5 is a longitudinal section through the dryer and burner tube of FIG. 4, with the outlet end of the burner tube being omitted.

As best shown in FIGS. 4 and 5, the duct 38 extends about a portion of the burner tube 40. Since the burner tube 40 houses the burner chamber 52, air passing through the duct 38 is preheated before being expelled into the duct 42. As shown in FIG. 4, the duct 38 extends about at least half of the circumference of the burner tube 40 for a portion of the lenght of the burner tube 40.

The burner chamber 52 also requires a source of fresh air for combustion purposes. Mounted within the housing 50 is an air flow tube 54 which is concentric with, and spaced from, the burner tube 40. The air flow tube 54 includes a collar 56 which seals the remainder of the area between the housing 50 and the air flow tube 54 so that air may enter only at the left end (in relation to FIG. 5) of the air flow tube 54. The housing 50 is open about the air flow tube 54, and as illustrated by flow arrows in FIG. 5, air enters the air flow tube 54 at the left end thereof, flowing in the space between the air flow tube 54 and the burner tube 40, and then entering an inlet end 58 of the burner tube 40. As shown in FIG. 5, the air flow tube 54 is spaced from the duct 38 to readily permit air to enter around the entire circumference of the burner tube 40.

Figure 3:
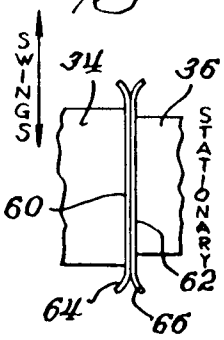
FIG. 3 is an enlarged view taken along lines 3—3 of FIG. 2.

Because the shell 14 is pivoted relative to the frame 12, the junctions of the duct 34 to the duct 36 and the duct 42 to the duct 44 must accomodate such pivoting. As best shown in FIG. 3 with respect to the ducts 34 and 36, the ducts join at respective flanged collars 60 and 62, with the collars abutting one another. For purposes of preventing interference between the collars when the shell 14 is pivoted, each collar includes an oppositely curved respective periphery 64 and 66 as best illustrated in FIG. 3.

The junction between the ducts 42 and 44 may be similar, or identical to, the junction between the ducts 34 and 36. That junction is, therefore, not described or shown in greater detail.

For sealing purposes, the dryer 10 also includes a seal system comprising a series of seals 68 and 70. The seals, and the nature of the sealing system, are described in greater detail in the applicant's copending U.S. patent application Ser. No. 329,395, filed Mar. 27, 1989, to which reference can be had for greater detail. The seals form no part of the present invention.

The dryer of the present invention operates as follows. With the shell 14 in normal position as shown in bold fashion in FIG. 1, the ducts 42 and 44, and 34 and 36, are in alignment. After a cake of wet linens is inserted into the tumbler cylinder 28, the dryer is activated, causing the burner chamber 52 to expel heated gases into the duct 42, which then enter the duct 44 and comingle with linens within the tumbler cylinder 28. Moist air is exhausted from the tumbler cylinder 28 through the duct 34 by the blower 30, with the air flow rate being controlled by a damper 72. The extracted moist air is then drawn into the duct 36, and depending on the position of the damper 48, a portion thereof or all of the moist air may be exhausted through the exhaust duct 46. Assuming that the damper 48 is in the position shown in bold in FIG. 1, however, the greatest portion of the air drawn from the tumbler cylinder 28 is recirculated into the duct 38, where it passes about the heated burner tube 40 and is therefore reheated. Upon exiting the duct 38, air comingles with heated air exiting the burner tube 40 into the duct 42, and the comingled fresh and recirculated air then enters the duct 44 and is introduced into the tumbler cylinder 28, and the entire process is repeated. Thus, by judicious selection of the position of the damper 48, a large portion of air may be recirculated through the air distribution system 16, assuring that the greatest amount of moisture possible is entrained within the air before it is exhausted through the exhaust duct 46.

Because the recirculated air extends about at least a portion of the burner tube 40, the recirculated air is not only reheated, but also it cools the burner tube 40. In addition, incoming, relatively cool ambient air enters the housing 50 and is conducted by the air flow tube 54 about the remaining periphery of the burner tube 40, thus cooling that portion, as well. Therefore, not only is the burner tube 40 cooled, but also incoming and recirculated gases are preheated, increasing the efficiency of the dryer 10.

Various changes can be made to the invention without departed from the spirit thereof or scope of the following claims.

What is claimed is:

1. In a dryer for extracting moisture from wet goods, the dryer including a tumbler cylinder housed within a shell and further including air distribution means for supplying heated air to the cylinder for drying goods therein, withdrawing air from the cylinder, and recirculating at least a portion of the air withdrawn from the cylinder, the improvement comprising a. said air distribution means including a burner chamber within a burner tube for providing heated air, b. heating passageway means disposed about at least a first portion of said burner tube, said heating passageway means being connected for directing recirculated air about said burner tube to cause the burner tube to heat the recirculated air, c. an inlet end for said burner tube, d. air flow tube means surrounding at least a second portion of said burner tube at said inlet end and located for directing ambient air about said second portion of said burner tube to said inlet end, and e. means providing ambient air to said air flow tube means.

2. A dryer according to claim 1 in which said burner tube is cylindrical and said heating passageway means comprises a duct.

3. A dryer according to claim 2 in which said duct extends about at least half of the circumference of said burner tube for part of the length thereof.

4. A dryer according to claim 2 in which said burner tube is cylindrical and said air flow tube means is concentric therewith.

5. A dryer according to claim 4 in which said air flow tube is formed so that the direction of air flow between said air flow tube and said burner tube is opposite to the direction of air flow within said burner tube.

6. A dryer according to claim 1 in which said air distribution means includes a recirculation duct extending from a location proximate said tumbler to said heating passageway means, and including means for exhausting recirculated air before air enters said heating passageway means.

7. A dryer according to claim 6 in which said means for exhausting comprises an adjustable damper located in said recirculation duct, and an exhaust duct associated with said damper to exhaust air directed to said exhaust duct by said damper.

8. A dryer according to claim 6 in which said shell is pivotable to expel the contents thereof, and in which said recirculation duct includes a first part pivotable with said shell and a fixed second part, and including a joint between said parts.

9. A dryer according to claim 8 in which said joint comprises a flanged collar on each of said parts, said collars abutting one another.

10. A dryer according to claim 9 in which each collar includes an oppositely curved periphery to prevent interference between the collars when said shell is pivoted.

* * * * *